United States Patent [19]

Schlegel et al.

[11] Patent Number: 4,946,173

[45] Date of Patent: Aug. 7, 1990

[54] THROWING RING

[76] Inventors: Jörg-Frieder Schlegel, Heidberg 48, 2000 Hamburg 60, Fed. Rep. of Germany; Gerhard Sattler, Grindelallee 80, 2000 Hamburg 13, Fed. Rep. of Germany

[21] Appl. No.: 342,163

[22] Filed: Apr. 24, 1989

[30] Foreign Application Priority Data

Apr. 22, 1988 [DE] Fed. Rep. of Germany ..... 3813491

[51] Int. Cl.[5] ..... A63H 27/00

[52] U.S. Cl. ..... 273/425

[58] Field of Search ..... 273/425, 424; 446/48

[56] References Cited

U.S. PATENT DOCUMENTS

| | | | |
|---|---|---|---|
| 4,104,822 | 8/1978 | Rodgers | 273/425 X |
| 4,307,535 | 12/1981 | Martin | 273/424 X |
| 4,560,358 | 12/1985 | Adler | 273/425 X |

*Primary Examiner*—Paul E. Shapiro

*Attorney, Agent, or Firm*—Michael J. Striker

[57] ABSTRACT

A throwing ring includes a substantially flat ring web having an outer edge, an inner edge defining a central opening, the ring web having a profile which over its periphery is periodically non-uniform and at both sides of a ring diameter is folding non-symmetrical.

20 Claims, 5 Drawing Sheets

THROWING RING

BACKGROUND OF THE INVENTION

The present invention relates to a throwing ring. More particularly, it relates to a throwing ring formed as a flat ring web with an outer edge, an inner edge which defines a central opening, an upper ring surface with a slightly curved cross-section, and a lower ring surface which form a profile of the web.

Throwing disc and especially throwing rings are known as objects for free time entertainment. With an average skill of a throwing person, this object can be thrown over considerable distances in a straight flight. Such throwing discs are disclosed for example in the U.S. Pat. Nos. 4,456,265 or 4,460,358. The object of the development of known flying rings is to achieve a maximum stable straight flight for covering considerable flight distances. A further flying game device which also requires the skill of a throwing person is a so-called boomerang. Upon a delivered throw, it enables a return of the throwing object to the throwing person.

The disadvantage of known throwing game devices is that they have only a one side useable special throwing technique and after a certain time the interest to the game device is easily lost.

SUMMARY OF THE INVENTION

Accordingly, it is an object of the present invention to provide a throwing game device, which allows a wide spectrum of possible throwing techniques and therefore provides for interesting throwing variations. It provides a stronger body control of the throwing person, keeps longer the fascination of the playing person.

It is another object of the present invention to provide such a device which allows both a stable straight flight with considerable flight distances and also a flying path which are similar to those of a boomerang.

In keeping with these objects and with others which will become apparent hereinafter, one feature of the present invention resides, briefly stated, a throwing ring, including a substantially flat ring web having an outer edge, an inner edge defining a central opening, the ring web having a profile which over its periphery is periodically non-uniform and at both sides of a ring diameter is folding non-symmetrical. During throwing of the ring, a different condition is produced, so as to enable either a straight flight or a boomerang-like flight path.

In accordance with a further feature of the present invention, the outer edge of the ring web has a plurality of outwardly projecting ring web lugs and a plurality of rearwardly offset ring web regions located therebetween to form a wave shape, the inner edge of the ring web also has a wave-shape and its apex points are directed radially to respective apex points of the outer edge, and an apex line of the upper ring surface is offset relative to the outer edge in a peripheral direction so that a first leg of each outwardly projecting ring web lug extends closer to the outer edge and the upper ring surface falls down from the apex line with a stronger curvature toward the outer edge and a longer flatter curvature toward the inner edge, while a second leg of the apex line extends closer to the inner edge and the upper ring surface falls down with stronger curvature toward the inner edge and longer and flatter curvature toward the upper edge.

The non-uniform profile is arranged on the projecting ring web lugs in an especially efficient manner so that the different aerodynamic lift conditions depending on the rotary direction are produced in an especially pronounced manner. Moreover, it can be designed structurally simple, which leads to advantageously lower programming cost for the production of a shaping tool on numerically controlled power tools.

In accordance with a further embodiment of the present invention the outer edge and the inner edge of each ring web run substantially parallel to one another. This feature also provides for a simple production, as well as respective simple shaping of the throwing ring.

In accordance with another feature of the present invention, the outer edge of the rearwardly offset ring regions and the inner edge of the ring web lugs have a substantially identical distance from a central axis of the throwing ring. In a surprising manner it has been shown that this design provides an especially stable straight flight.

A further feature of the present invention is that the ring web has a maximum thickness of between 2 and 4 mm and a width of between 6 and 15%, advantageously 8 to 12%, of the maximal outer diameter of the throwing ring. This construction provides for an especially favorable aerodynamic lift condition both in the straight flight and in the return flight.

A further feature of the present invention is that the lower ring surface completely or in its partial region is advantageously circular ring shaped and inclined at an angle of between 1° and 3° relative to the center axis of the throwing ring in a conically raising manner. This feature provides a stability increase during the straight flight.

In accordance with a further embodiment of the present invention, the lower ring surface has slightly concavely grooved regions. Thus a further aerodynamic lift increase and thereby longer throwing distances are achieved in the straight flight.

In accordance with another embodiment of the invention, the lower ring surface has a small grooving over its periphery substantially following and located opposite to the curved apex line, which leads to a surprising aerodynamic lift increase in the straight flight.

A further feature of the present invention is that the outer edge and the inner edge each have a sinus-like or trapezoidal wave shape, for example with a wave length approximately 2.5–6 times the width of the ring web. It has been shown in a surprising manner that not only the sinus-like wave shapes, but also trapezoidal wave shapes have simimlar flight conditions when the dimensioning in accordance with the present invention is maintained.

In accordance with a further embodiment of the present invention, the ring web is composed of wood or synthetic plastic material, and has for example a weight per unit area with reference to the area value of the lower ring surface between 0.1 and 0.8 g/cm$^2$ and preferably between 0.2 and 0.5 g/cm$^2$. This parameter provides for an optimization between a favorable throwing weight and especially advantageous flow conditions without the need for excessively high throwing energy which is dangerous upon impact. This parameter is also advantageous for the production of the throwing ring of wood or similar materials which are not dangerous in handling. Also, the production from such materials is especially price favorable.

In accordance with a further embodiment of the invention, the wave shape of the outer edge and for example also the inner edge, is asymmetrical so that each first leg of each ring web lug extends steeper outwardly and the second leg is offset back with a smaller steepness. Such a dimensioning provides for an optimal compromise between the stable straight flight with satisfactory aerodynamic lift conditions for long throwing distances and with outstanding return flight conditions. This is especially true when the curved apex line is arranged with periodically varying distance from the outer edge, for example at location closer to the outer edge with distance of 0.2–0.4 times the width of the ring web.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
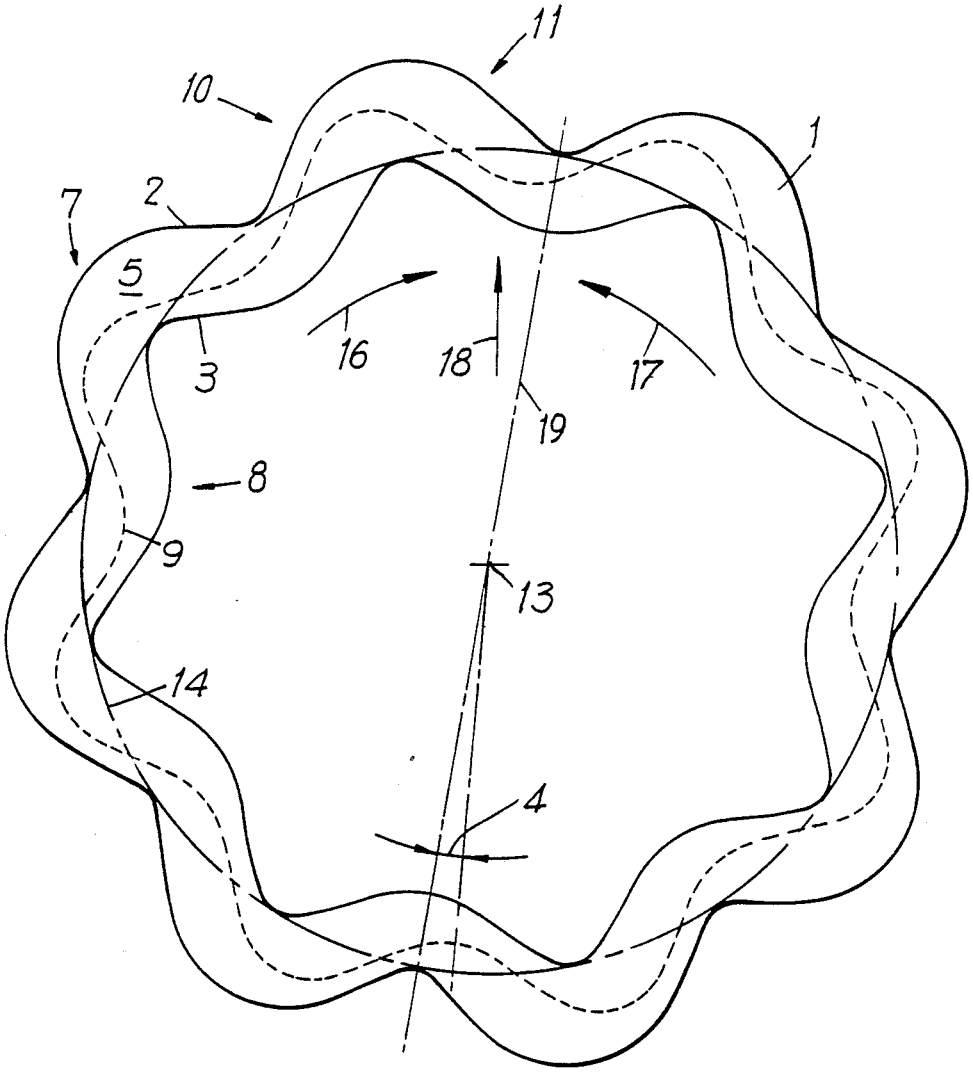
FIG. 1 is a plan view of a throwing ring in accordance with the present invention.

FIG. 1 shows a plan view of an inventive throwing ring. A throwing ring has a wave-shaped ring web which is identified with reference numeral 1. The ring web has an outer edge 2 and an inner edge 3. The edges 2 and 3 extend parallel to one another.

Due to the wave-shaped design of the ring web, the periphery of the ring web has a plurality of ring web lugs 7 and rearwardly extending ring regions 8 which are arranged in alternating order on the periphery of the ring. A curvature apex line 9 is identified in a broken line between the outer edge 2 and the inner edge 3. It extends on an upper ring surface 5 relative to the wave-shaped outer edge 2 in a peripheral direction with such an offset that in a first leg 10 of the outwardly projecting ring web lug it is closer to the outer edge 2 and in a second leg 11 it is closer to the inner edge 3. In this embodiment the curved line 9 is formed as a line which is located centrally between the inner edge 3 and the outer edge 2, but is offset by an offset angle 4 relative to the center point 13 of the ring.

The outwardly directed apex points of the inner edge and the inwardly directed apex points of the outer edge are arranged to substantially contact a joint circle 14 about the center point 13. This is a feature which further increases the flying stability of the ring.

Figure 2:
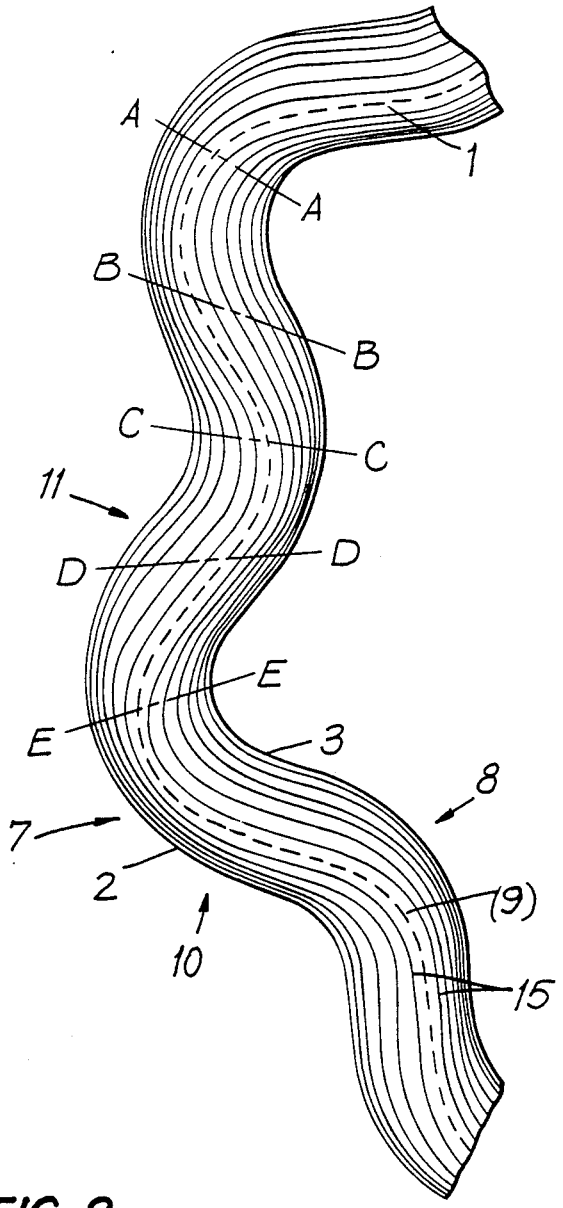
FIG. 2 is a plan view of a part of the inventive throwing ring showing lines of height.

FIG. 2 shows a partial region of the inventive throwing ring. The lines of height are shown here for illustrating the shape of the throwing ring. The curved apex line 9 which is shown in this Figure in dotted line extends between both lines of height 15, at a maximum distance from one another. The shown cutting lines a—a, b—b, c—c, d—d, and e—e, identify radial sections illustrated in FIG. 3.

Figure 3:
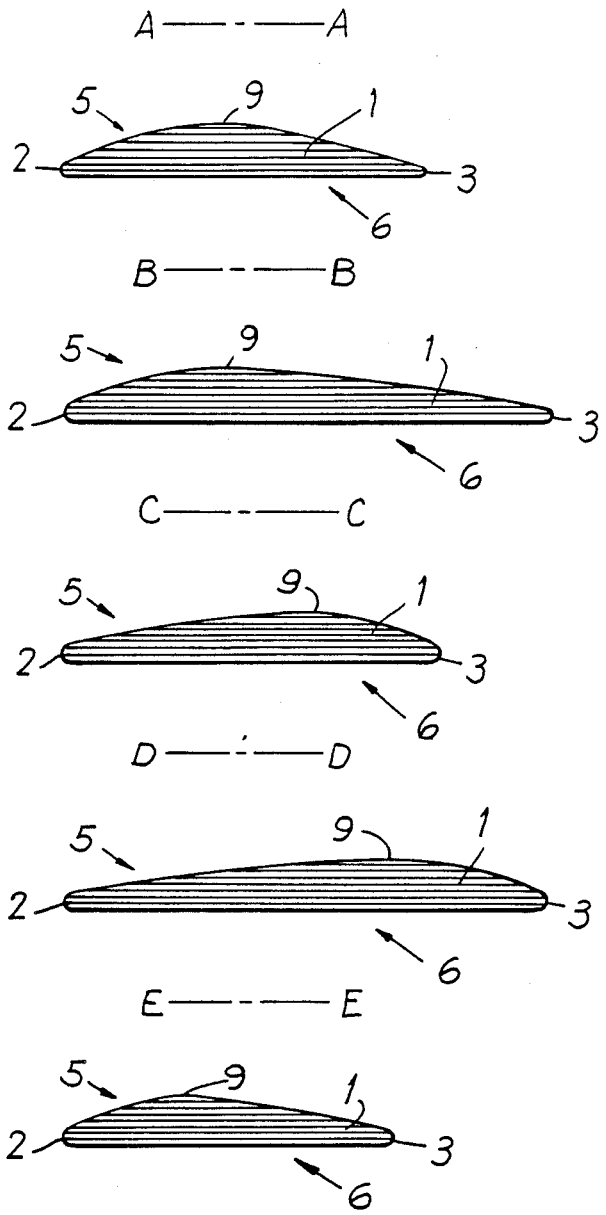
FIG. 3 is a view showing several cross-sections of the inventive throwing ring taken along the cutting lines identified in FIG. 2.

As can be seen from FIG. 3, the profile sections presented in this Figure clearly show the periodical profile course over the periphery of the throwing ring. In these profiles the profile height remains identical, while the profile depth and the position of the curved apex line 9 vary. Due to this, completely different convexities of the upper ring surface 5 are produced. The lower ring surface 6 is in all cases maintained flat.

Figure 5:
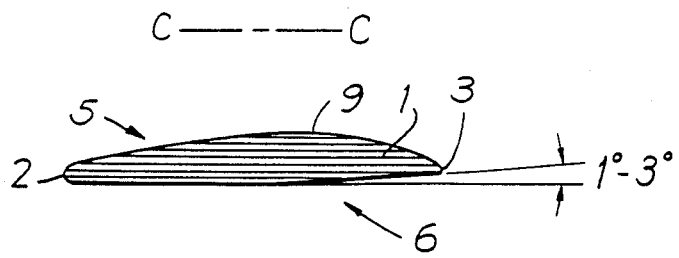
FIGS. 5–7 show further embodiments of the inventive throwing ring.
Figure 6:
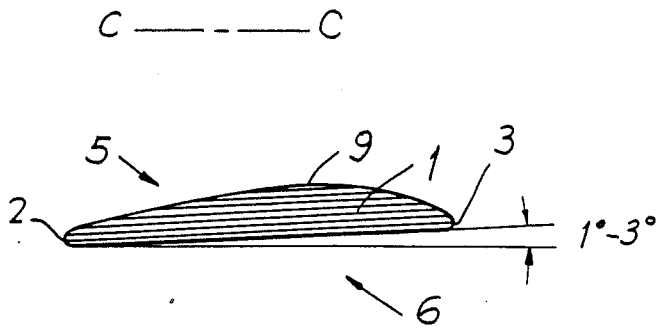
Figure 7:
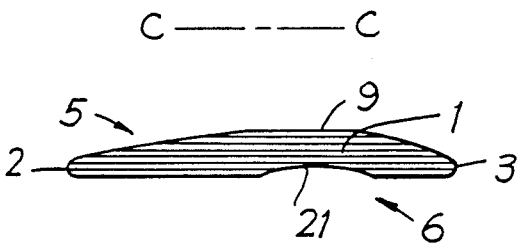

In accordance with the present invention it is possible that the lower surface either has a little grooving 21 relative to the curved apex line 9 as shown in FIG. 7 or in partial regions of the ring web lugs has slightly concave grooved regions. It is also within the spirit of the invention that the lower ring surface slightly conically raises toward the center axis of the throwing ring either at least in its partial region as shown in FIG. 5 or as a whole as shown in FIG. 6. Also, different combinations of these shapes are possible as well.

Figure 4:
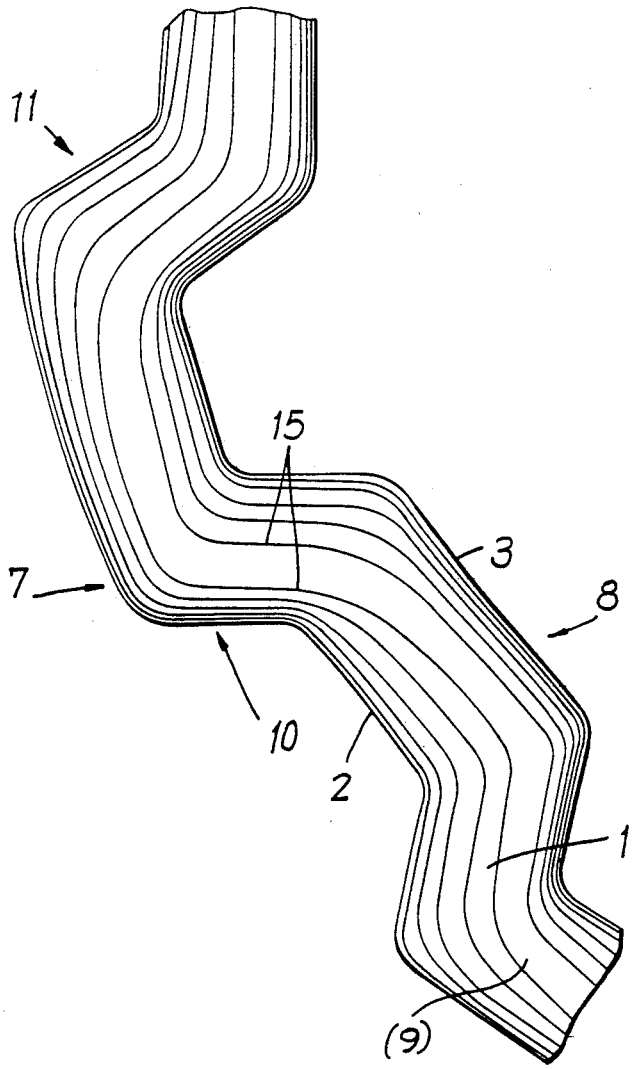
FIG. 4 is a view showing a part of the inventive throwing ring in accordance with a further embodiment of the present invention.

FIG. 4 shows a throwing ring which substantially corresponds to the ring of FIG. 2, and has a trapezoidal wave-shape. Such construction is within the frame of the present invention as well as further asymmetrically shaped profiles, for example, in form of saw-teeth-like ring webs. Parts which are similar with the parts of the first embodiment are identified with the same reference numerals.

The throwing ring in accordance with the present invention must be handled so that a thrower is located transversely to wind. For right-handed persons the wind must come from the left side. For the boomerang-like return flight, the ring is thrown with a powerful movement forwardly with the arm extending laterally, and shortly before its release obtains inwardly clockwise directed superposed rotary speed by a fast movement of the hand joint. Depending on the applied throwing energy, the ring raises under the action of its active aerodynamic lift upwardly to 10–15 meter above the throwing point. The point of a maximal distance of substantially 40–50 meters is approximately the highest point of the flight path. At this point the vector of the flight speed is minimal. Under the action of gravitation, the vector of the flight speed reduces from here in an opposite direction with simultaneous change of its direction to so-called return flight. When a ratio of rotation energy is selected respectively to throwing energy, the ring returns over droplet shaped flight path (which can vary to elliptical or hair pin shaped flight path) exactly to the thrower.

For the straight flight, with the same positioning of the ring it is held with the right hand in front of the body horizontally and then forcefully thrown forwardly. Shortly before its release, a fast movement of the hand joint outwardly produces the required rotary speed contrary to the clockwise direction for the stable straight flight. During throwing the ring must be thrown as horizontal as possible. The wind direction during this type of throwing is of subordinary importance. When the ring is thrown, even an unskilled thrower can reach up to 100 meter. With a certain skill also a distance of 150 meter can be reliably reached.

Left handers perform a similar handling. The flight condition is achieved by the opposite direction of the superposed rotary movement.

An interesting and fascinating throwing game can be performed with the throwing ring of the present invention. The game is possible for a single person or a couple, and depending on the skill of the thrower, can fly over unexpected and impressive flight paths.

It will be understood that each of the elements described above, or two or more together, may also find a useful application in other types of constructions differing from the types described above.

While the invention has been illustrated and described as embodied in a throwing ring, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A throwing ring, including a substantial flat ring web having an outer edge, an inner edged defining a central opening, said ring web having a profile which over its periphery is periodically non-uniform and is folding non-symmetrically at both sides of a ring diameter, said throwing web having a plurality of outwardly projecting ring web lugs and a plurality of inwardly offset ring web regions located between said ring web lugs and together forming said outer edge in a substantially wave-shape, said inner edge also having a substantially wave-shape such that its apex points are directed radially toward respective apex points of said outer edge, an apex point line of said upper surface being offset relative to said outer edge in a peripheral direction so that in a first leg of each of said outwardly projecting ring web lugs it extends closer to said outer edge and said upper ring surface falling down from said apex line with a stronger curvature toward said outer edge and a longer and flatter curvature relative to said inner edge, while in a second leg is said apex line it extends near said inner edge and said upper ring surface falling down with a stronger curvature toward said inner edge and with a longer and flatter curvature relative to said upper edge.

2. A throwing ring as defined in claim 1, wherein said outer edge and said inner edge of said ring web extend substantially parallel to one another.

3. A throwing ring as defined in claim 1, wherein said outer edge of said rearwardly offset ring web regions and said inner edge of said ring web lugs are located substantially at a same distance from a center axis of said ring web.

4. A throwing ring as defined in claim 1, wherein said ring web has an outer diameter between 15 and 45 cm, said ring web having a maximum thickness of between 2 and 4 mm and a width of between 6 and 15% of a maximimal outer diameter of said ring web.

5. A throwing ring as defined in claim 1, wherein said ring web has a diameter between 20 and 40 cm, said ring web having a width of 8–12% of the outer diameter.

6. A throwing ring as defined in claim 1, wherein said lower ring surface is a plan surface.

7. A throwing ring as defined in claim 1, wherein said lower ring surface at least in its partial region extends at an angle between 1° and 3° relative to a central axis of said ring web in a conically raising manner.

8. A throwing ring as defined in claim 7, wherein said lower ring surface extends as a whole at said angle.

9. A throwing ring as defined in claim 1, wherein said lower ring surface has slightly concave grooved regions.

10. A throwing ring as defined in claim 9, wherein said lower ring surface has a slight grooving extending over its periphery substantially opposite to said apex line.

11. A throwing ring as defined in claim 1, wherein said outer edge and said inner edge have a sinus-like wave shape.

12. A throwing ring as defined in claim 1, wherein said outer edge and said inner edge have a wave-shape with a wave length which is 2.5–6 times the width of said ring web.

13. A throwing ring as defined in claim 1, wherein said ring web is composed of wood.

14. A throwing ring as defined in claim 1, wherein said ring web is composed of synthetic plastic material.

15. A throwing ring as defined in claim 1, wherein said ring web has a weight per unit area relative to an area value of said lower ring surface between 0.1 and 0.8 $g/cm^2$.

16. A throwing ring as defined in claim 15, wherein said weight relative to said area value of said lower ring surface is between 0.2 and 0.5 $g/cm^2$.

17. A throwing ring as defined in claim 1, wherein said apex line is arranged with periodically varying distance from said outer edge.

18. A throwing ring, including a substantially flat ring web having an outer edge, an inner edge defining a central opening, said ring web having a profile which over its periphery is periodically non-uniform and is folding non-symmetrically at both sides of a ring diameter, said inner edge and said inner edge having a trapezoidal wave shape.

19. A throwing ring, including a substantially flat ring web having an outer edge, an inner edge defining a central opening, said ring web having a profile which over its periphery is periodically non-uniform and is folding non-symmetrical at both sides of a ring diameter, said outer edge having a wave shape which is asymmetrical so that a first leg of each of said ring web lugs projects steeper outwardly and a second leg of the same extends back less steep.

20. A throwing ring as defined in claim 19, wherein said inner edge also has a wave shape substantially similar to said wave shape of said outer edge.

* * * * *